US006605005B1

(12) United States Patent
Lin

(10) Patent No.: US 6,605,005 B1
(45) Date of Patent: Aug. 12, 2003

(54) DETACHABLE LASER POINTER FOR GOLF PUTTER

(76) Inventor: Tony Lin, 2F, No. 137, Sec. 1, Hua Mei West St., Taichung (TW)

( * ) Notice: Subject to any disclaimer, the term of this patent is extended or adjusted under 35 U.S.C. 154(b) by 0 days.

(21) Appl. No.: 10/198,084

(22) Filed: Jul. 19, 2002

(30) Foreign Application Priority Data

Apr. 17, 2002 (TW) ..... 91205116 U

(51) Int. Cl.[7] ..... A63B 69/36
(52) U.S. Cl. ..... 473/220; 473/223
(58) Field of Search ..... 473/220, 221, 473/223, 226

(56) References Cited

U.S. PATENT DOCUMENTS 3,070,373 A * 12/1962 Mathews et al. ..... 473/220
3,820,795 A * 6/1974 Taylor ..... 473/220
3,953,034 A * 4/1976 Nelson ..... 473/220
5,207,429 A * 5/1993 Walmsley et al. ..... 473/220
5,388,831 A * 2/1995 Quadri et al. ..... 473/220
5,465,972 A * 11/1995 Cornett ..... 473/220
5,472,204 A * 12/1995 English et al. ..... 473/220
5,848,944 A * 12/1998 Brannen ..... 473/409
5,964,668 A 10/1999 Tai et al.
6,004,230 A * 12/1999 Hooker ..... 473/409
6,066,052 A 5/2000 Li
6,227,983 B1 5/2001 Yang
6,238,298 B1 * 5/2001 Chen ..... 473/220
6,450,893 B1 * 9/2002 Primiano et al. ..... 473/220
6,488,592 B1 * 12/2002 Boatner ..... 473/220

* cited by examiner

*Primary Examiner*—Paul T. Sewell
*Assistant Examiner*—Nini F. Legesse
(74) *Attorney, Agent, or Firm*—Browdy and Neimark, P.L.L.C.

(57) ABSTRACT

A detachable laser pointer is constructed to include a mounting base, the mounting base having a smoothly arched rear coupling groove for coupling to the shaft of a golf putter and a locating plate of C-shaped cross section upwardly extended from the smoothly arched coupling groove for plugging in between the shaft and grip of the golf putter and a front receiving groove, a joint rotatably coupled to the receiving groove, a laser module pivoted to the joint and adapted for emitting a laser beam to aim the putter head of the golf putter to the hole.

8 Claims, 6 Drawing Sheets

DETACHABLE LASER POINTER FOR GOLF PUTTER

FIELD OF THE INVENTION

The present invention relates to a training device of golf and, more specifically, to a detachable laser pointer adapted for use with a golf putter to aim the putter head at the hole.

BACKGROUND OF THE INVENTION

Golf putters with laser pointer (sight) means are known. Exemplars are seen in U.S. Pat. Nos. 6,227,983; 6,066,052; 5,964,668, etc. According to U.S. Pat. Nos. 6,227,983 and 6,066,052, the laser pointer is directly installed in the putter head, and controlled to emit a laser beam (or two laser beams) perpendicular to the striking face of the putter head. Because the laser pointer is directly installed in the putter head, it is not detachable for use with a regular golf putter without laser pointer means. Another drawback of these designs is that the user may not be able to see the laser beam clearly when looked at the ground because the laser beam extends from the front side of the striking face of the putter head. Furthermore, because the switch of the laser pointer is provided at the putter head, the user must stop the action of aiming the putter head at the hole when switching the switch.

U.S. Pat. No. 5,964,668 disclosed a laser pointer which is mounted on the shaft of the golf putter near the grip of the golf putter by means of a clamp. The laser pointer is controlled to emit a laser beam to aim the striking face of the putter head to the hole, which can be seen by the user clearly. However, this clamp and laser pointer assembly is bulky and heavy. When installed in a golf putter, the clamp and laser pointer assembly destroys the sense of beauty of the golf putter and, affects the smoothness of the user's action in operating the golf putter. In addition, it is complicated when installing the laser pointer on the golf putter. Furthermore, the regular golf putter has various diameters which may not be fit for the clamp such that the emitted laser beam may be vibrational or oscillatory when in use.

SUMMARY OF THE INVENTION

It is the primary object of the present invention to provide a detachable laser pointer for golf putter, which is compact and convenient for carrying by hand.

It is another object of the present invention to provide a detachable laser pointer for golf putter, which can easily and positively be installed in any of a variety of golf putters to emit a clear laser beam onto the ground to aim the putter head at the hole.

To achieve these objects of the present invention, a detachable laser pointer comprises a mounting base, a joint, a laser module, and a power switch. The mounting base has a smoothly arched coupling groove disposed in one side thereof, a locating plate upwardly extended from the coupling groove, and a receiving groove disposed in one side thereof opposite to the coupling groove. The joint has a coupling block disposed at one end thereof and detachably mounted in said receiving groove, and a pivot portion disposed at an opposite end thereof. The laser module has a housing provided with a pivot portion pivoted to the pivot portion of the joint for enabling said housing to be turned upward/downward relative to said joint, a laser diode and circuit board assembly installed in the housing and adapted for emitting a laser beam out of said housing, and a power source installed in the housing and adapted for providing electricity to the laser diode and circuit board assembly. The power switch is electrically connected to the power source of the laser module and adapted for switching on/off the laser diode and circuit board assembly.

DETAILED DESCRIPTION OF THE INVENTION

Figure 1:
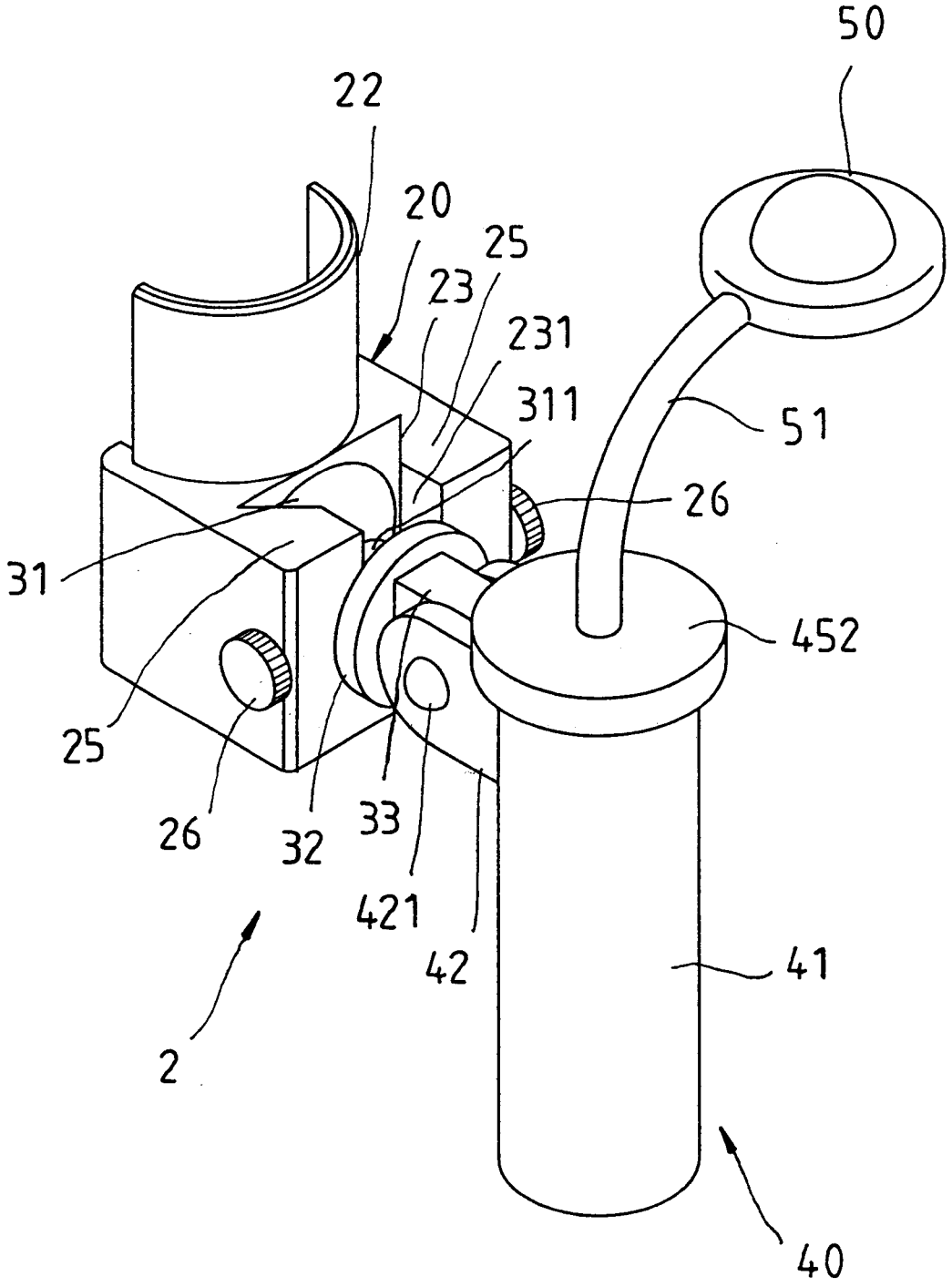
FIG. 1 is a perspective view of a detachable laser pointer for golf putter according to a preferred embodiment of the present invention.

Referring to FIGS. from 1 through 4, a detachable laser pointer 2 is shown comprised of a mounting base 20, a joint 30, a laser module 40, and a switch 50.

Referring to FIGS. from 1 through 3 again, the mounting base 20 comprises a semicircular positioning groove 21 disposed in one vertical peripheral side, namely, the rear vertical peripheral side and vertically extended to the top and bottom sides, a locating plate 22 of C-shaped cross section vertically upwardly extended from the top side in line with the semicircular coupling groove 21, a coupling groove, for example, a dovetail groove 23 disposed in another vertical peripheral side, namely, the front vertical peripheral side, a stop member 24 in the dovetail groove 23 near the bottom side of the mounting base 20, two jaws 25 integral with the front vertical peripheral side at two sides of a front opening 231 of the dovetail groove 23, and two holding down screws 26 respectively installed in the jaws 25. The holding down screws 26 are aimed at each other and rotated in and out of the front opening 231 of the dovetail groove 23 at two sides. By means of press-fitting the locating plate 22 into the gap between the shaft 10 and the grip 11 and attaching the semicircular positioning groove 21 to the periphery of the shaft 10, the mounting base 20 is fastened to the shaft 10 of the golf putter.

Figure 2:
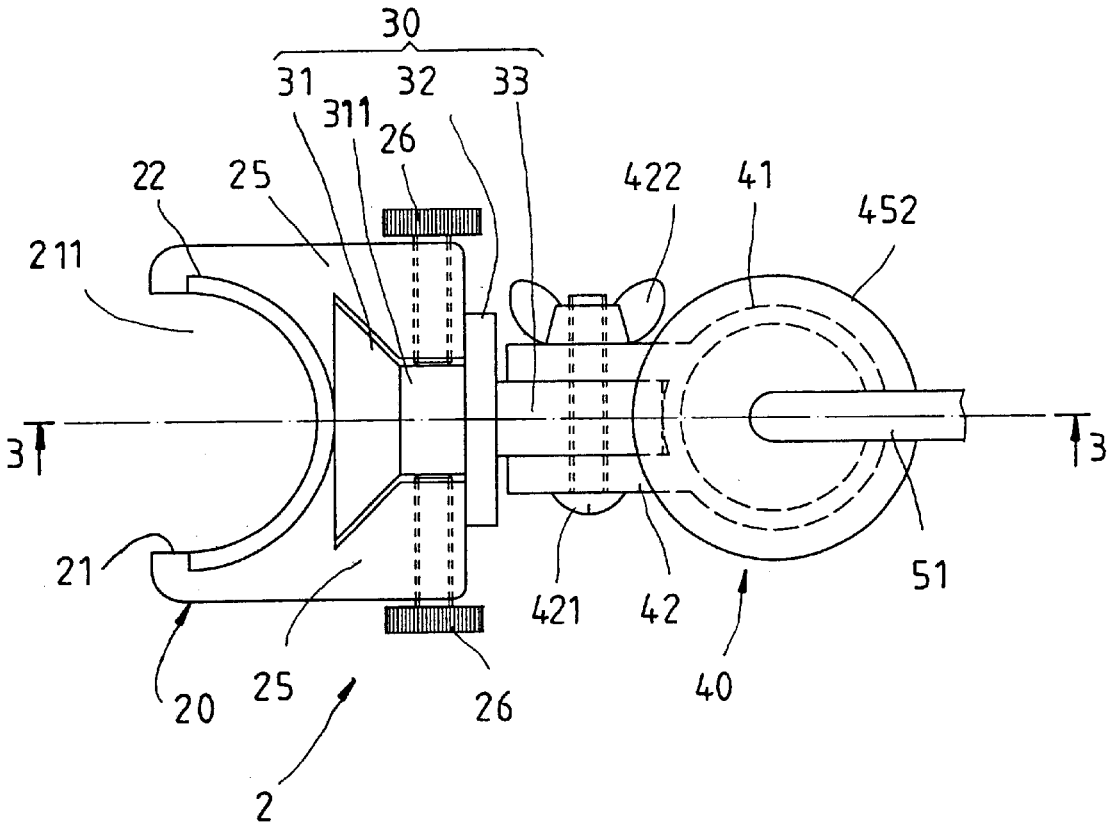
FIG. 2 is a top view of the detachable laser pointer for golf putter according to the preferred embodiment of the present invention.
Figure 3:
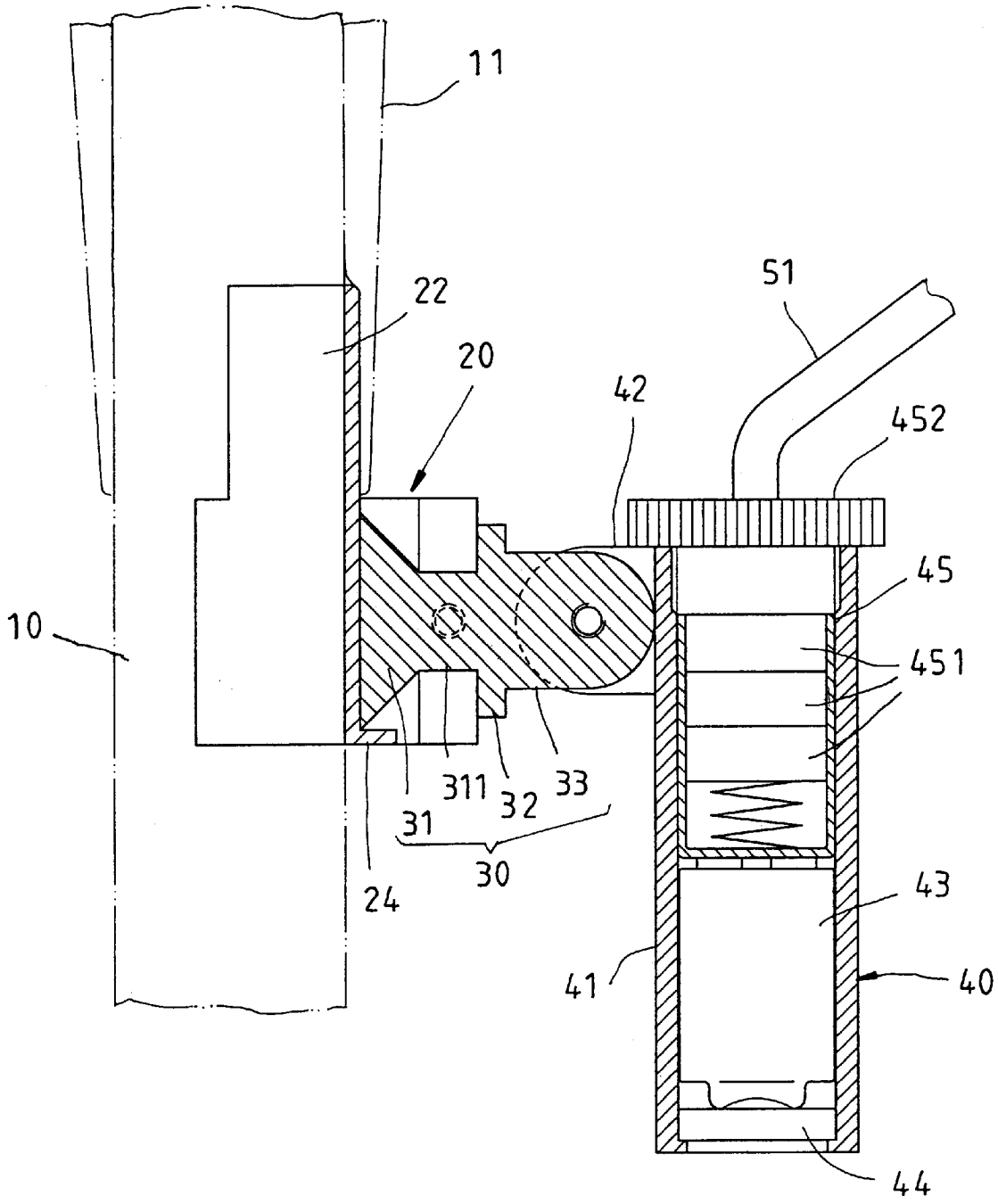
FIG. 3 is a sectional view in an enlarged scale taken along line 3—3 of FIG. 2.

Referring to FIGS. 2 and 3 again, the joint 30 comprises a coupling block 31 fitting the dovetail groove 23, a neck 311 perpendicularly backwardly extended from the back of the coupling block 31 and received in the front opening 231 of the dovetail groove 23, a shoulder 32 connected to one end of the neck 311 remote from the coupling block 31 and adapted for stopping at the front vertical peripheral side of the mounting base 20 when the coupling block 31 engaged into the dovetail groove 23, and a pivot portion which is a connecting arm 33 in this embodiment perpendicularly backwardly extended from the shoulder 32 opposite to the neck 311 and adapted for coupling to the laser module 40. When the coupling block 31 is received in the dovetail groove 23, it can be rested on the stop member 24 so as to fix the coupling block in position. The coupling block 31 has a dimension larger than that of the front opening 231, thereby preventing the coupling block 31 from escaping from the front opening 231.

Referring to FIG. 2 again, after the coupling block 31 engaged into the dovetail groove 23, the holding down screws 26 are fastened tight and stopped against the neck 311 at two sides to hold down the joint 30, and at the same time the jaws 25 are stretched outwards by the joint 30, thereby causing semicircular positioning groove 21 to contrast and to narrow the opening 211, and therefore the peripheral wall of the semicircular positioning groove 21 is firmly stopped at the periphery of the shaft 10.

Referring to FIGS. 2 and 3 again, the laser module 40 comprises a housing 41, a pivot portion which is two coupling arms 42 in this embodiment perpendicularly extended from the periphery of the housing 41 and bilaterally pivoted to the connecting arm 33 of the joint 30 by a bolt 421 and a wing nut 422, a lens 44 in (a laser firing hole) in one side, namely, the bottom side of the housing 40, a laser diode and circuit board assembly 43 installed in the housing 41 behind the lens 44 and adapted for emitting a laser beam out of the housing 41 through the lens 44, a battery holder 45 mounted in the housing 41 in the other side, namely, the top side to hold a set of battery cells 451 and adapted for providing the necessary working voltage to the laser diode and circuit board assembly 43, and a cap 452 fastened to the top side of the housing 41 to hold the battery holder 45 in position. When loosened the wing nut 422, the laser module 40 can be turned about the bolt 421 relative to the joint 30 (the shaft 10) to the desired angle.

Referring to FIGS. 1 and 3 again, the switch 50 comprises a signal line 51 fastened to the cap 452 of the laser module 40 and electrically connected to the circuit between the battery holder 45 and the laser diode and circuit board assembly 43 for on/off control.

Figure 4:
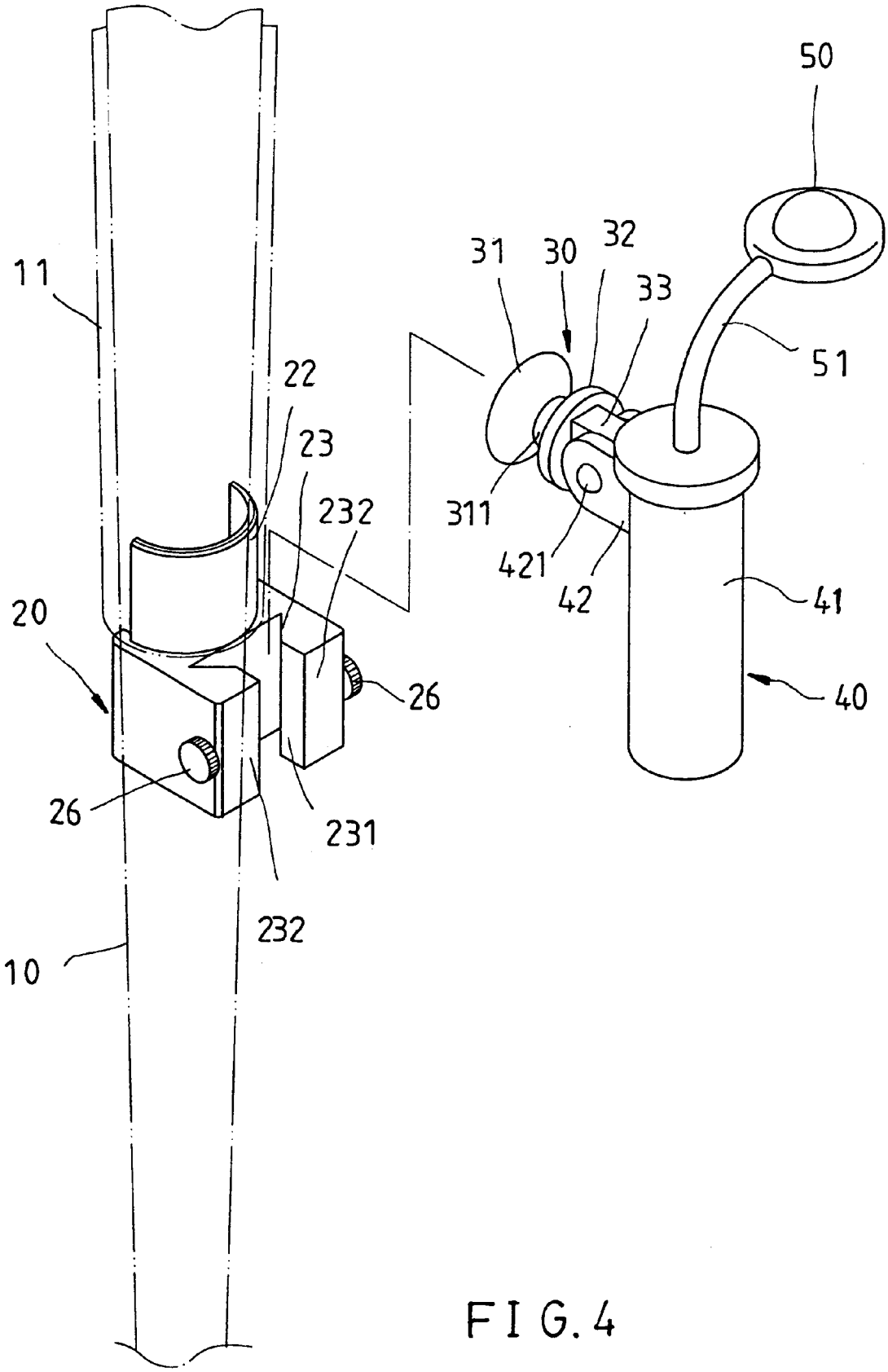
FIG. 4 is an installed view showing the installation of the detachable laser pointer for golf putter in the shaft of a golf putter according to the preferred embodiment of the present invention.

Referring to FIG. 4 again, before use, the locating plate 22 of the mounting base 20 is press-fitted into the gap between the shaft 10 and the grip 11 of the golf putter to secure the mounting base 20 to the shaft 11 of the golf putter, and then the coupling block 31 of the joint 30 is engaged into the dovetail groove 23, and then the holding down screws 26 are fastened tight to fix the joint 30 in position, and then the wing nut 422 is fastened up to fix the laser module 40 in the desired angular position. After use, the user can detach the laser module 40 with the joint 30 from the mounting base 20, keeping the mounting base 20 secured to the shaft 10 of the golf putter.

Figure 5:
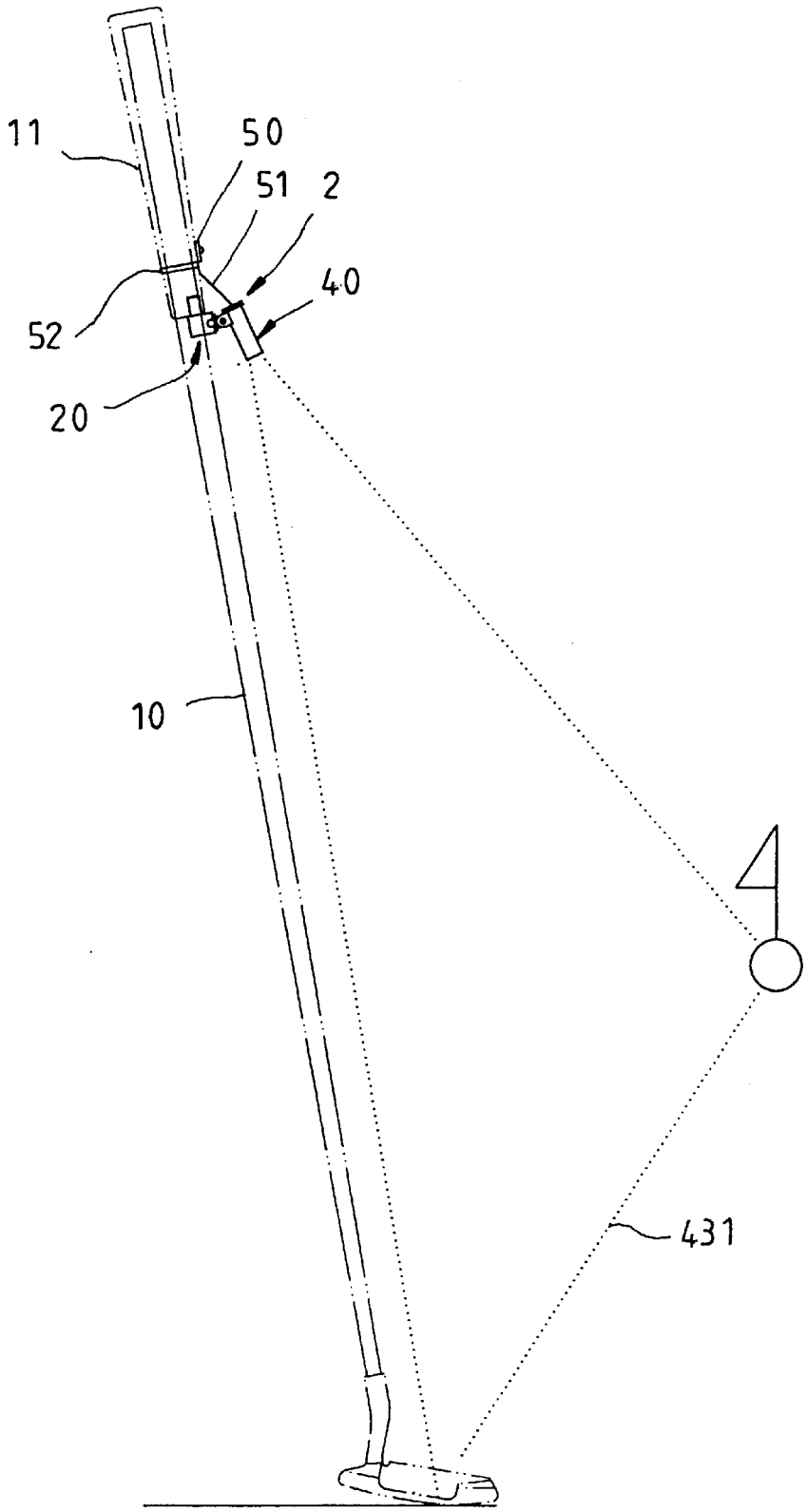
FIG. 5 is a schematic drawing showing an application example of the present invention.

Referring to FIG. 5, a fastening belt 52 may be used to fix the switch 50 to the grip 11 of the golf putter. After the laser module 40 has been adjusted to the desired angle, the switch 50 is switched to drive the laser module 40 to emit a laser beam 431 for aiming the striking face of the putter head of the golf putter at the hole. Further, before fastening up the holding down screws 26, the user can rotate the coupling block 31 in the dovetail groove 23 clockwise/counterclockwise to adjust the angular position of the laser module 40, that is, adjust the position of the laser beam 431 emitted.

In the aforesaid embodiment as shown in FIG. 1, the locating plate 22 is formed integral with the mounting base 20 (injection molded with the mounting base from plastics). Alternatively, the mounting base and the locating plate can be separately made and then fastened together.

Figure 6:
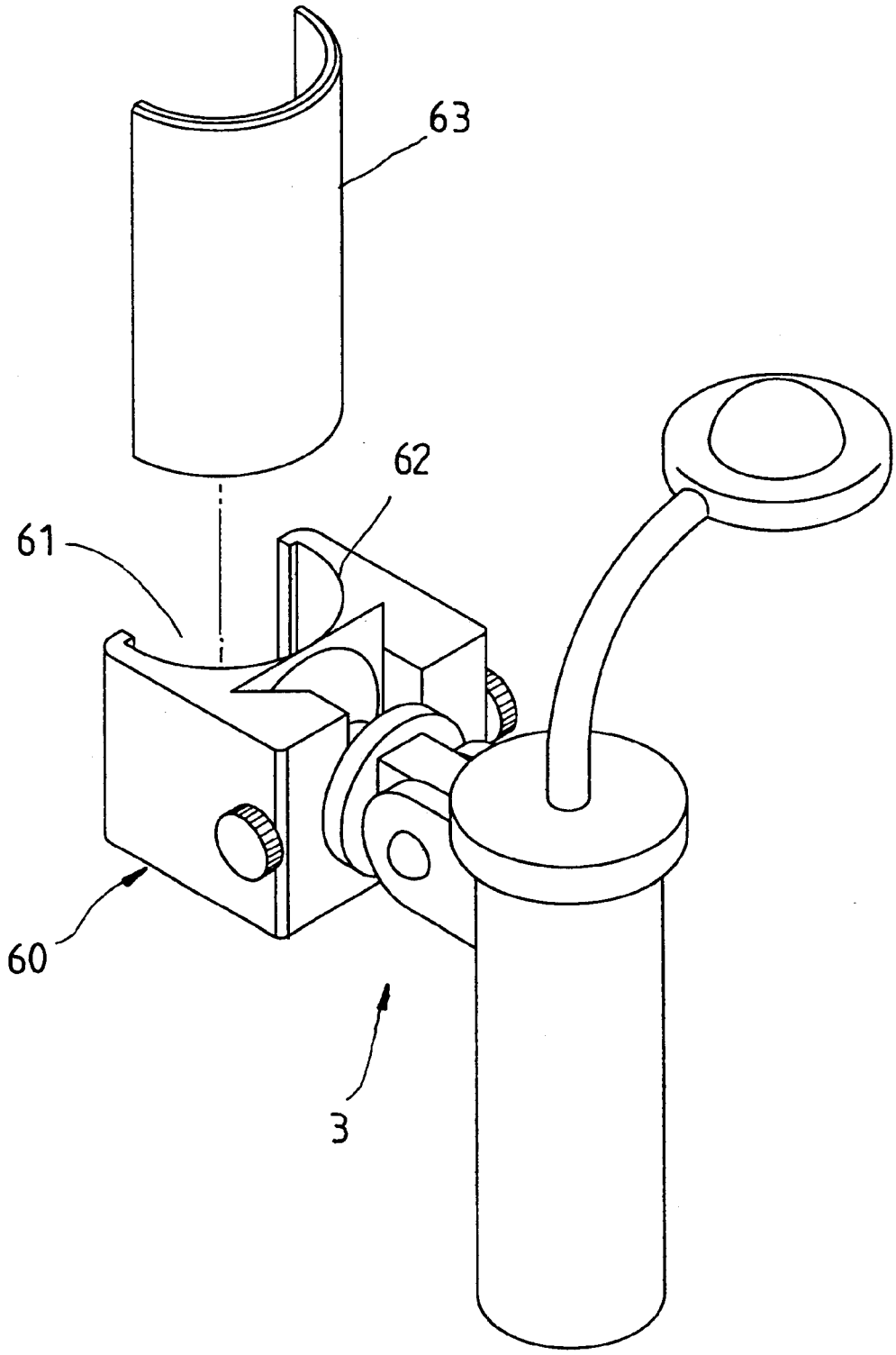
FIG. 6 is an exploded view of a detachable laser pointer for golf putter according to another preferred embodiment of the present invention.

FIG. 6 shows an alternate form of the present invention. According to this embodiment, the mounting base 60 of the laser pointer 3 comprises a semicircular coupling groove 62 for the positioning of a locating plate 63, which can be pre-inserted in between the grip and the shaft of the golf putter when installed, adapted for securing the mounting base 60 to the shaft of a golf putter.

What is claimed is:

1. A detachable laser pointer adapted for fastening to the connection area between the shaft and grip of a golf putter, the detachable laser pointer comprising:

a mounting base having a smoothly arched coupling groove disposed in one side thereof, a locating plate upwardly extended from said smoothly arched coupling groove and adapted for inserting in between the shaft and grip of the golf putter, and a receiving groove disposed in one side thereof opposite to said smoothly arched coupling groove;

a joint having a coupling block disposed at one end thereof and detachably mounted in said receiving groove, and a pivot portion disposed at an opposite end thereof;

a laser module having a housing provided with a pivot portion pivoted to the pivot portion of the joint for enabling said housing to be turned vertically relative to said joint, a laser diode and circuit board assembly installed in said housing and adapted for emitting a laser beam out of said housing, and a power source installed in said housing and adapted for providing electricity to said laser diode and circuit board assembly; and a power switch electrically connected to said power source of said laser module and adapted for switching on/off said laser diode and circuit board assembly.

2. The detachable laser pointer as claimed in claim 1, wherein said mounting base has a front opening in communication with said receiving groove, two jaws disposed at two sides of said front opening, and two holding down screws respectively installed in said jaw and adapted for holding down the coupling block of said joint in said receiving groove.

3. The detachable laser pointer as claimed in claim 2, wherein said joint further comprises a shoulder connected between the coupling block and pivot portion thereof and adapted for stopping at the periphery of said mounting base outside said front opening after engagement of the coupling block of said joint in said receiving groove of said mounting base; wherein the coupling block has a dimension larger than that of the front opening, thereby preventing the coupling block from escaping from the front opening.

4. The detachable laser pointer as claimed in claim 3, wherein said joint further comprises a neck connected between the coupling block and the shoulder thereof for receiving in said front opening of said mounting base after engagement of the coupling block of said joint in said receiving groove of said mounting base, and the coupling block of said joint can be rotated with said joint and said laser module clockwise/counter-clockwise in said receiving groove of said mounting base to adjust the angular position of said laser module and to fix in position by said two holding down screws.

5. The detachable laser pointer as claimed in claim 2, wherein said mounting base has a stop member disposed in a bottom side inside said receiving groove and adapted for supporting the coupling block of said joint in said receiving groove.

6. The detachable laser pointer as claimed in claim 1, wherein the pivot portion of said joint is an elongated connecting arm; the pivot portion of said laser module is comprised of two parallel coupling arms bilaterally pivoted to said elongated connecting arm by a bolt inserted through said elongated connecting rod and said coupling arms and a wing nut threaded onto said bolt and adapted for fixing said connecting rod in between said two coupling arms.

7. The detachable laser pointer as claimed in claim 1, wherein further comprises a signal line interconnected to said power source and said switch.

8. The detachable laser pointer as claimed in claim 7 further comprising a fastening belt adapted for securing said switch to the shaft of the golf putter on which said mounting base is installed.

* * * * *